US008814306B2

(12) United States Patent
Mizes et al.

(10) Patent No.: US 8,814,306 B2
(45) Date of Patent: Aug. 26, 2014

(54) SYSTEM AND METHOD FOR ELIMINATING BACKGROUND IMAGE DATA IN INK IMAGES IN AN INKJET PRINTER

(71) Applicant: Xerox Corporation, Norwalk, CT (US)

(72) Inventors: Howard A. Mizes, Pittsford, NY (US); Jack T. LeStrange, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 94 days.

(21) Appl. No.: 13/717,212

(22) Filed: Dec. 17, 2012

(65) Prior Publication Data

US 2014/0168301 A1 Jun. 19, 2014

(51) Int. Cl.
*B41J 29/38* (2006.01)
*B41J 2/21* (2006.01)

(52) U.S. Cl.
CPC ..... *B41J 2/2103* (2013.01)
USPC ..... 347/14; 347/19; 347/41

(58) Field of Classification Search
CPC .... B41J 29/38; B41J 11/0095; B41J 2/14153; B41J 11/007; B41J 11/42; B41J 13/0009
USPC ..... 347/14, 15, 16, 19, 40, 41, 42, 101
See application file for complete search history.

(56) References Cited

U.S. PATENT DOCUMENTS

| | | | | |
|---|---|---|---|---|
| 6,335,978 | B1 | 1/2002 | Moscato et al. | |
| 7,686,445 | B2 | 3/2010 | Fioravanti et al. | |
| 7,869,099 | B2 | 1/2011 | Mashtare | |
| 8,132,885 | B2 | 3/2012 | Ramakrishnan et al. | |
| 8,579,408 | B2 * | 11/2013 | Kelly et al. | 347/19 |
| 8,662,625 | B2 * | 3/2014 | Donaldson | 347/19 |

* cited by examiner

*Primary Examiner* — Thinh Nguyen
(74) *Attorney, Agent, or Firm* — Maginot, Moore & Beck, LLP

(57) ABSTRACT

An inkjet printer is configured to capture image data of a bare rotating imaging surface and use the image data of the bare rotating imaging surface to remove noise from subsequent images of printed ink on the rotating imaging surface. A controller in the printer is configured to measure cross-correlations between margins in the bare rotating imaging surface image data and margins in the subsequent images of printed ink to identify areas of alignment between the image data of the bare rotating imaging surface and the subsequent images of printed ink. The data in the areas in the image data of the bare rotating imaging surface that are aligned with areas in the subsequent images are used to remove the background noise produced by structure in the rotating imaging surface.

16 Claims, 8 Drawing Sheets

SYSTEM AND METHOD FOR ELIMINATING BACKGROUND IMAGE DATA IN INK IMAGES IN AN INKJET PRINTER

TECHNICAL FIELD

This disclosure relates generally to indirect inkjet printers, and, in particular, to indirect inkjet printers that use optical data of an imaging member to evaluate and correct operation of components within the inkjet printer.

BACKGROUND

In general, inkjet printing machines or printers include at least one printhead that ejects drops or jets of liquid ink onto a recording or imaging surface. The imaging surface can be the surface of a rotating member, such as a rotating drum or belt, or it can be a layer of material mounted to a rotating drum or belt, which is called a "blanket" in this document. "Imaging surface" refers to both the surface of a rotating member and a blanket in this document.

A print cycle in these indirect printers typically includes preparation of the imaging surface for printing, formation of the ink image on the treated imaging surface, preparation of the ink image for transfer to media, transfer of the ink image from the imaging surface to the media, and treatment of the image on the media before egress of the media from the printer. The cycle is repeated for subsequent images. Operation of components that perform one or more portions of the print cycle can be monitored and adjusted with reference to image data generated by directing light towards the imaging surface and detecting the amplitude of the reflected light with an optical sensor. These optical sensor image data can be processed to distinguish ink from imaging surface background to identify position and size of the ink on the imaging surface. From these measurements, a controller can determine whether the surface treatment components, printheads, and transfer components are working within an acceptable range and, if necessary, adjust the components to bring their operation within an acceptable range.

The imaging surfaces in inkjet printers may have structure that causes significant variations in the reflected light. When these reflectivity variations are close to the variations caused by the contrast between the colorant and the substrate, the precision of the image quality measurement is adversely affected. Changes in the imaging surface velocity, which are not uncommon, also make alignment of the two images difficult. Methods and systems that are more robust with regard to imaging surface velocity variations would be beneficial.

SUMMARY

A method of operating an inkjet printer enables the reflection variations caused by features in an imaging surface to be removed. The process includes generating with an optical sensor having a plurality of detectors first image data of a surface of a rotating member while the surface is bare of ink, the rotating member being positioned to rotate in front of at least one printhead to form an ink image on the surface of the rotating member. The at least one printhead is operated to eject ink onto the surface of the rotating member with reference to data stored in the printer, and second image data of the surface of the rotating member is generated while the ejected ink corresponding to the data stored in the printer is on the surface of the rotating member. The first image data is aligned with the second image data, and noise is reduced in the second image data with reference to the first image data aligned with the second image data. The second image data having the reduced noise is processed to identify the ejected ink on the surface of the rotating image member, and the printer is operated with reference to the ejected ink identified on the surface of the rotating image member.

An inkjet printer is configured remove reflection variations caused by features in an imaging surface to be removed from image data of an imaging surface. The inkjet printer includes at least one printhead configured to eject ink, and a rotating member positioned to rotate in front of the at least one printhead to enable the at least one printhead to eject ink onto a portion of a surface of the rotating member to form an ink image on the surface portion of the rotating member. At least one optical sensor having an a linear array of detectors extends across a width of the rotating member and the optical sensor is configured to generate image data of the surface portion of the rotating member and a margin of the surface of the rotating member. A controller is operatively connected to the at least one optical sensor, and the controller is configured to receive from the at least one optical sensor first image data of the surface portion and margin of the rotating member without ink, operate the at least one printhead to eject ink on the surface portion of the rotating member, the ejected ink corresponding to data stored in a memory of the printer, receive from the at least one optical sensor second image data of the surface portion and margin of the rotating member bearing the ejected ink, align the first image data that corresponds to the margin of the rotating member with the second image data that corresponds to the margin of the rotating member, reduce noise in the second image data that corresponds to the surface portion of the rotating member with reference to image data in the first image data in the surface portion, the image data in the first image data used to reduce noise being aligned with the image data in the margin of the rotating member in the first image data that is aligned with the second image data that corresponds to the margin of the rotating member, process the second image data having reduced noise to identify the ejected ink on the surface portion of the rotating member, and operate the printer with reference to the ejected ink identified on the surface portion of the rotating member.

DETAILED DESCRIPTION

Figure 1:
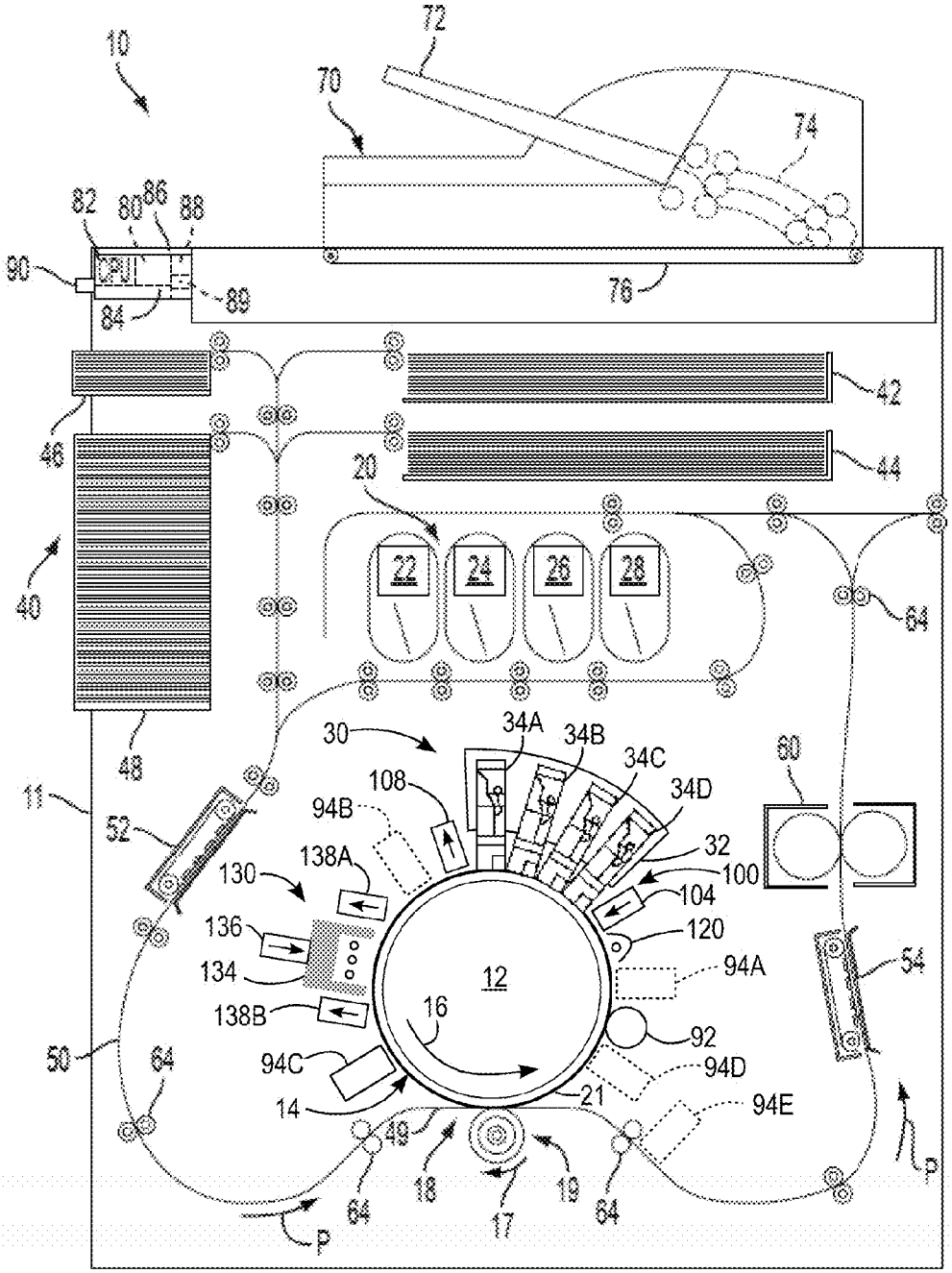
FIG. 1 is a schematic drawing of an aqueous indirect inkjet printer that produces ink images on media sheets.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct or indirect printer.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

FIG. 1 illustrates a high-speed aqueous ink image producing machine or printer 10. As illustrated, the printer 10 is an indirect printer that forms an ink image on a surface of a blanket 21 mounted about an intermediate receiving member 12 and then transfers the ink image to media passing through a nip 18 formed with the blanket 21 and intermediate imaging member 12. A print cycle is now described with reference to the printer 10. As used in this document, "print cycle" refers to the operations of a printer to prepare an imaging surface for printing, ejection of the ink onto the prepared surface, treatment of the ink on the imaging surface to stabilize and prepare the image for transfer to media, and transfer of the image from the imaging surface to the media.

The printer 10 includes a frame 11 that supports directly or indirectly operating subsystems and components, which are described below. The printer 10 includes an image receiving member 12 that is shown in the form of a drum, but can also be configured as a supported endless belt. The image receiving member 12 has an outer blanket 21 mounted about the circumference of the member 12. The blanket moves in a direction 16 as the member 12 rotates. A transfix roller 19 rotatable in the direction 17 is loaded against the surface of blanket 21 to form a transfix nip 18, within which ink images formed on the surface of blanket 21 are transfixed onto a media sheet 49.

The blanket is formed of a material having a relatively low surface energy to facilitate transfer of the ink image from the surface of the blanket 21 to the media sheet 49 in the nip 18. Such materials include silicones, fluro-silicones, Viton, and the like. A surface maintenance unit (SMU) 92 removes residual ink left on the surface of the blanket 21 after the ink images are transferred to the media sheet 49. The low energy surface of the blanket does not aid in the formation of good quality ink images because such surfaces do not spread ink drops as well as high energy surfaces. Consequently, some embodiments of SMU 92 also apply a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like. In other embodiments, a surface energy applicator 120, which is described in more detail below, operates to treat the surface of blanket for improved formation of ink images without requiring application of a coating by the SMU 92.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material such as anilox. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface of the blanket 21.

The printer 10 includes an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also includes a surface energy applicator 120 positioned next to the blanket surface at a position immediately prior to the surface of the blanket 21 entering the print zone formed by printhead modules 34A-34D. The surface energy applicator 120 can be, for example, a corotron, a scorotron, or biased charge roller. The surface energy applicator 120 is configured to emit an electric field between the applicator 120 and the surface of the blanket 21 that is sufficient to ionize the air between the two structures and apply negatively charged particles, positively charged particles, or a combination of positively and negatively charged particles to the blanket surface and/or the coating. The electric field and charged particles increase the surface energy of the blanket surface and/or coating. The increased surface energy of the surface of the blanket 21 enables the ink drops subsequently ejected by the printheads in the modules 34A-34D to be spread adequately to the blanket surface 21 and not coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes an infrared heater 134, a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the image receiving member 12 onto the media sheet 49.

The rotation or rolling of both the image receiving member 12 and transfix roller 19 not only transfixes the images onto the media sheet 49, but also assists in transporting the media sheet 49 through the nip. The image receiving member 12 continues to rotate to continue the transfix process for the images previously applied to the coating and blanket 21.

Figure 2:
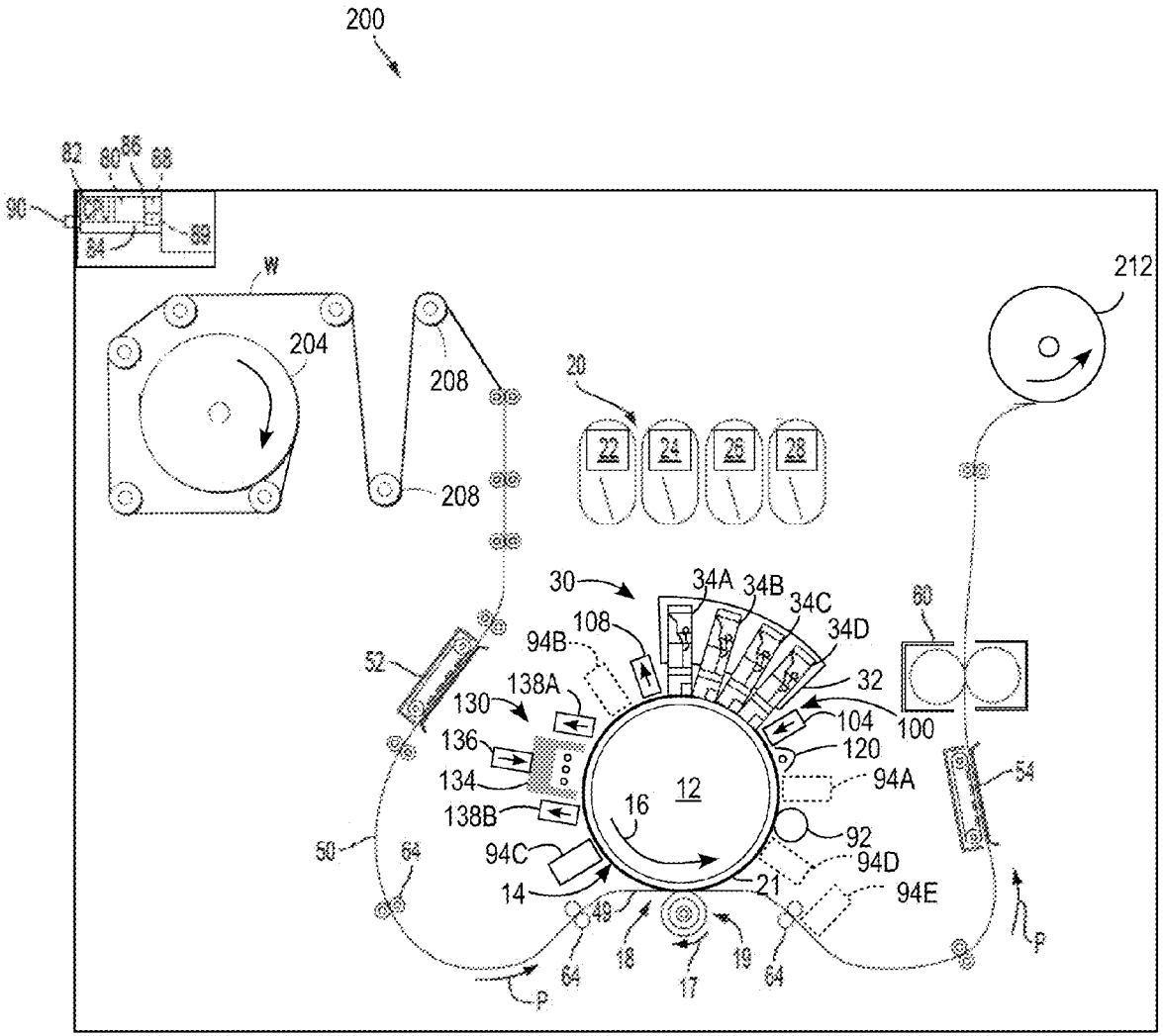
FIG. 2 is a schematic drawing of an aqueous indirect inkjet printer that produces ink images on a continuous media web.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. One configuration of the printer 200 winds the printed media onto a roller for removal from the system by rewind unit 214. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in this embodiment in synchronization with the arrival of media at the nip to receive an ink image and is separated from the blanket to remove the nip as the trailing edge of the media leaves the nip.

As noted above, an aqueous printer having the structure shown in FIG. 1 or FIG. 2 can have one optical sensor 94A, 94B, 94C, or 94D, or any combination or permutation of image sensors at these positions about the rotating member 12. The advantage of having multiple image sensors is that the print cycle can be completed in a single revolution of the rotating member. When only one image sensor is provided in a printer, then an operation must occur with respect to a portion of the imaging surface followed by continued rotation of the imaging surface so that portion reaches the optical sensor, which is operated to generate image data of the surface that can be analyzed to evaluate the operation. The imaging surface then continues to rotate until the portion of the surface that was imaged reaches the next operational station position so an operation can be performed, the surface rotated until that portion reaches the optical sensor for imaging to evaluate the next operation performed on the surface. For example, in a printer embodiment having a single optical sensor, the imaging member continues rotation following surface treatment of a portion of the imaging member by the surface energy applicator 120 without operating the printheads 34A to 34D to eject ink or activating the heater 130 so the treated portion of the imaging surface can be imaged by optical sensor 94C, when optical sensor 94C is the only optical sensor in the printer. The rotation of the imaging member continues until the treated portion begins to pass the printheads and then the printheads are operated to eject ink onto the treated portion to form an ink image. The ink image may or may not be subjected to heat from heater 130 before being imaged by the optical sensor 94C. Once the image is transferred, the imaging member can be rotated until the portion of the imaging surface where the ink image was formed passes the optical sensor 94C so image data of the surface can be generated to evaluate the efficiency of the image transfer. This type of multi-pass print cycle can be used to enable printer embodiments with only one optical sensor or less than all of the optical sensors 94A, 94B, 94C, and 94D to generate image data of the imaging member surface to scrutinize the performance of various components in the printer.

In printers that have all of the optical sensors 94A, 94B, 94C, and 94D, image data of the imaging surface can be generated after each of the operations of surface treatment and printing with applicator 120 and printheads 34A-34D, drying the ink image with heater 130, transferring the image at nip 18, and cleaning the surface with SMU 92. If evaluation of the surface treatment needs to be tested independently of printing, then another optical sensor could be installed between the applicator 130 and the printhead 34D, although the characteristics on the imaging surface provide good insight into the effectiveness of the surface treatment. Additionally, optical sensor 94E is provided if the quality of the ink image on media is to be tested.

To address the issues arising from the difficulty in synchronizing image data of a bare imaging surface with image data of a portion of the imaging surface during printing, the system and method described below use template matching at multiple sections of the previously acquired image and the current image to locally align the two images. This template matching enables structure in the background surface that causes variations in the reflected light to be removed from the current image despite motion variations that occur between the capture of the bare surface image and the printed image. Even if the subsequent image capture starts at the same angular position of the imaging surface as the bare surface capture began, the $n^{th}$ scanline may correspond to a different location on the media because of surface speed fluctuations occurring during the capture of the image data. Further improvement in local matching can be obtained by interpolating a matched template between the two adjacent scanlines that straddle the position where the two images begin to synchronize. These interpolated values can be used to remove bare surface features from the current printed image.

Figure 3:
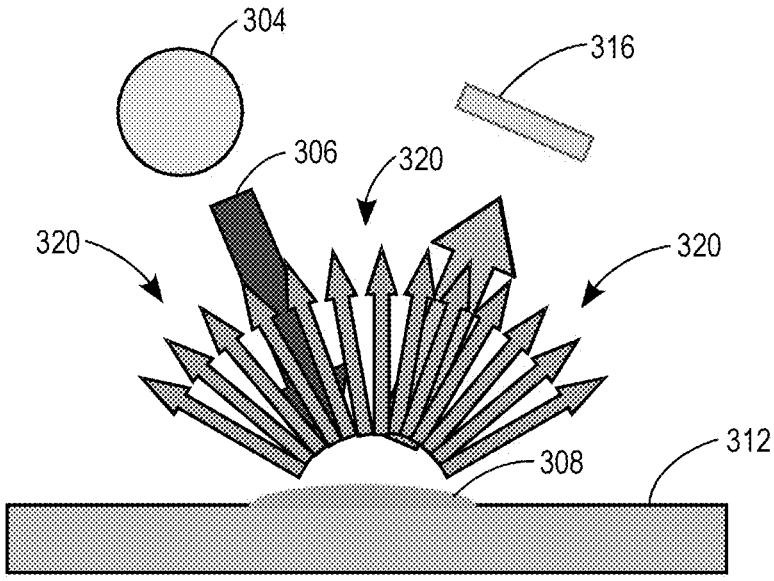
FIG. 3 is an illustration of a light source and detector interacting with ink on an imaging surface.

As shown in FIG. 3, a light source 304 directs light 306 towards a drop of ink 308 on an imaging surface 312. Specular reflection of the light is at an angle of reflection equal to the angle of incidence with respect to the surface and a detector 316 is located to receive this specular reflection. The textured surface of the imaging surface also diffusely reflects light in the various directions 320. The source of the texture may be variations in the surface material, which cause variations in the amount of light reflected, and variations in the surface geometry, which cause slight changes in the angle of the reflected light. Because the texture is not uniform across the surface 312, some areas reflect more light specularly than others, and some of this specularly reflected light may be directed more towards the sensor than other specular light. These different areas cause the response of the detector to vary depending upon the amount of light reflected specularly into the detector. The structure in the surface that produces the texture can be finer than the resolution of the detector so a detector response can be a superimposition of brighter areas and dimmer areas. As noted above, the optical sensors include a linear array of detectors that extend beyond the edges of the imaging surface in the cross-process direction to ensure the entire width of the imaging surface is imaged. Thus, the illustration of FIG. 3 is repeated for each detector in an optical sensor.

Each detector in the linear array of an optical sensor also has a gain and an offset. The offset, as used in this document, means the signal produced by a detector when the light source is not activated to direct light towards the surface 312. Gain, as used in this document, refers to the change in the signal generated by a detector for each unit of incident light collected by a detector during one sampling period. Gain is typically measured by capturing the response of the detectors to a known amount of incident light on the surface 312.

Figure 4:
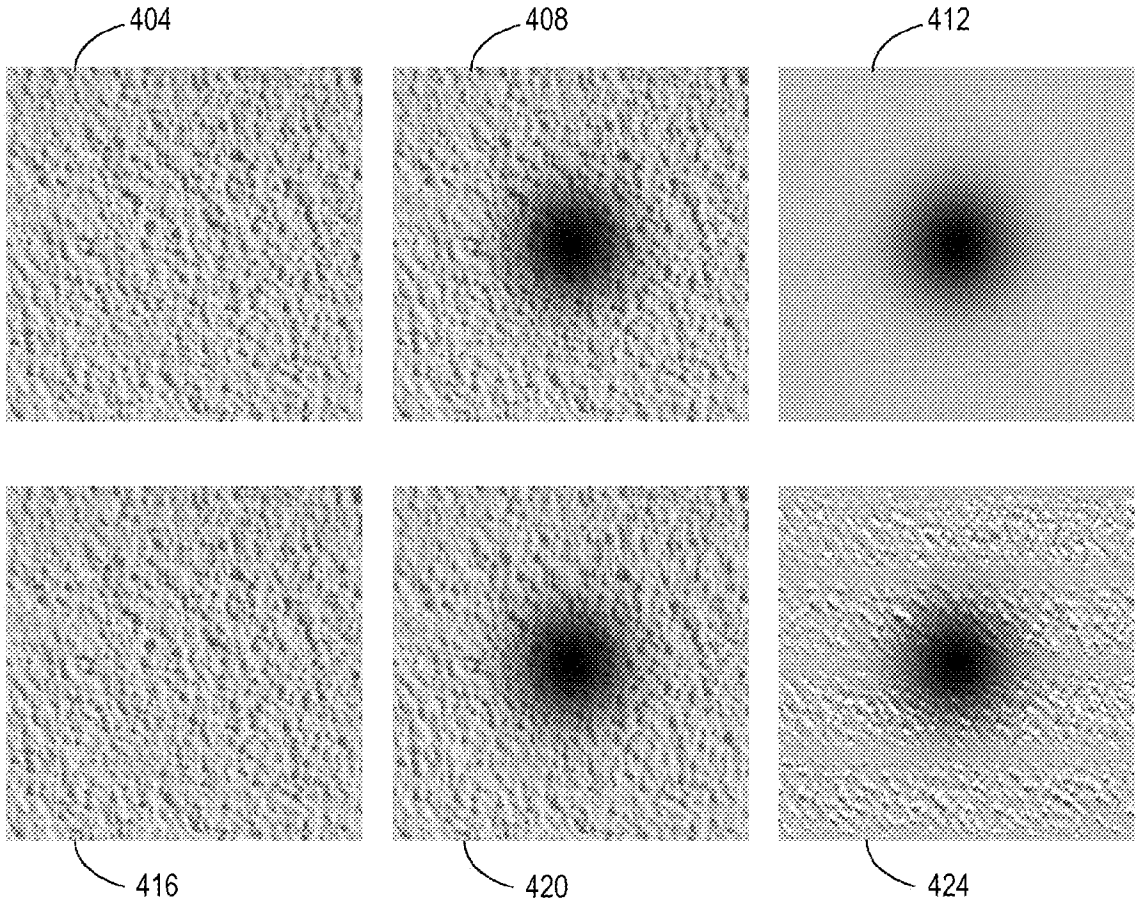
FIG. 4 is a depiction of a successful removal of noise from correctly synchronized images of an imaging surface and of an unsuccessful removal of noise from images of an imaging surface that are not correctly synchronized.

If two images of the imaging surface are obtained, one of the bare surface and a second of ink ejected onto the imaging surface, then the ratio of these two images gives a response that is dependent on the amount of ink and independent of the surface structure. In order to perform this simple process, however, the first image must be accurately aligned with the second image. In practice, such alignment is often difficult because the surface speed of the imaging surface varies as it rotates under the detectors of the optical sensor. FIG. 4 shows exaggerated images demonstrating this effect of speed variation in two captures of a portion of an imaging surface. Image 404 is a first image of the surface without ink, image 408 is a subsequent image of the surface after a drop of ink has been ejected onto the surface, and image 412 is the ratio of image 404 and image 408. During the capture of image 404 and 408, the surface speed is very uniform and the ratio of the two images yields an image in which the background noise has been removed. Image 416 is a first image of the surface without ink, image 420 is a subsequent image of the surface after a drop of ink has been ejected onto the surface, and image 424 is the ratio of image 416 and image 420. During the capture of image 416 and 420, the surface speed is not uniform and the ratio of the two images yields an image in which a portion of the background noise remains.

One solution to this problem is to use reflex scanning. In reflex scanning, an encoder on the support of the imaging surface generates a synchronizing signal that triggers the capture of each scan line in the image. As used in this document, a "scanline" refers to the response to each detector in an optical sensor at one particular sampling time. This synchronization based on the encoder signal ensures that the detectors of the sensor are imaging the same area of the imaging surface in both images. However, a reflex scanner requires electronic components to generate and coordinate with the encoder signal. The method described below enables a first set of image data to be aligned with a second subsequent set of image data so the ratio of the two images remove background noise without requiring an encoder and associated electronics.

Figure 10:
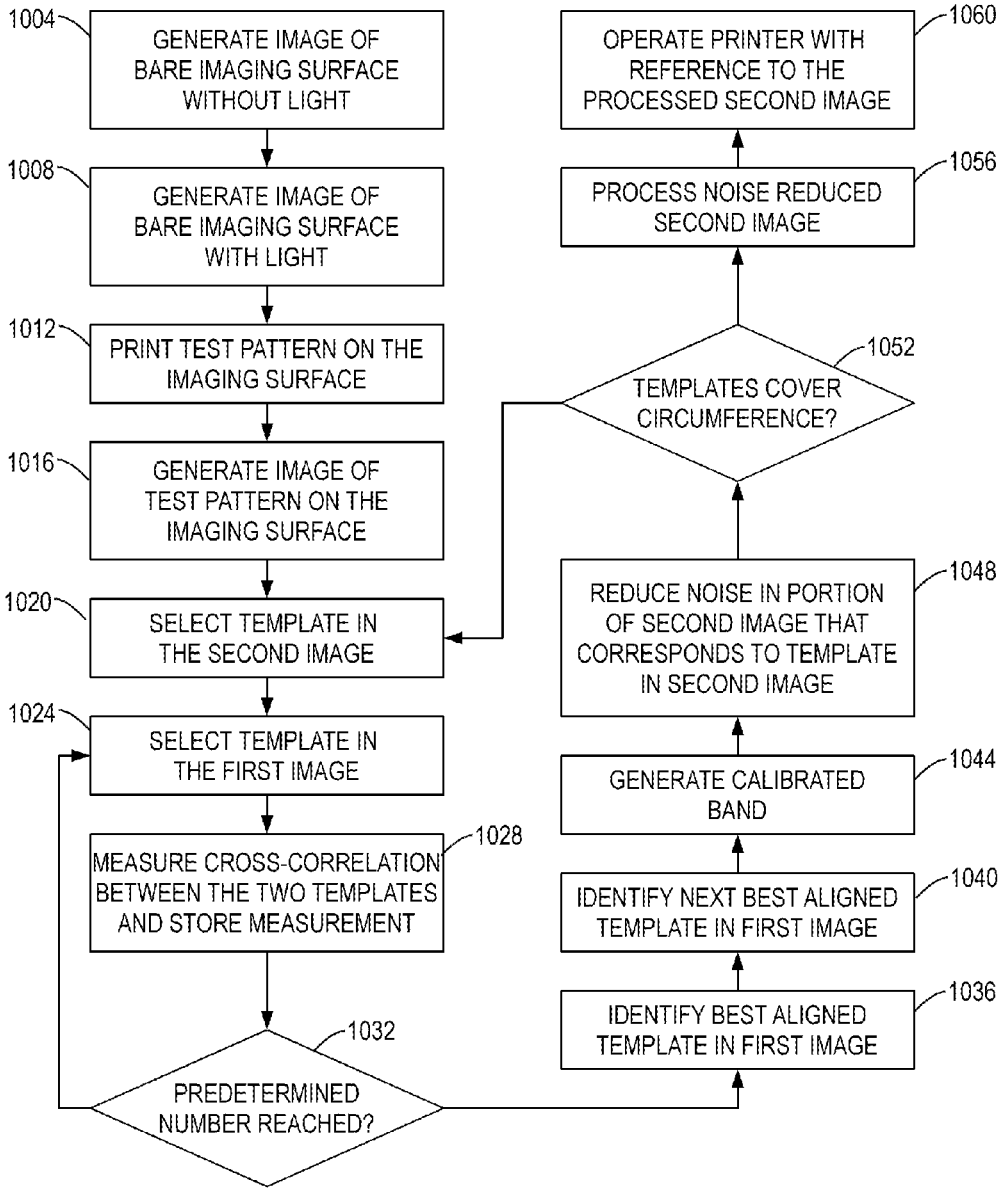
FIG. 10 is a flow diagram of a process used to remove background noise with reference to two images of an imaging surface taken at different times.

A process 1000 for aligning two sets of image data of a same surface is shown in FIG. 10. In the description of the method, a statement that the process is performing some function refers to a processor or controller executing programmed instructions stored in a memory operatively connected to the processor or controller to operate one or more printer components to perform the function. The process 1000 begins with an image capture of the imaging surface without the light source(s) for an optical sensor being activated (block 1004). These image data are stored to identify the offsets for the detectors in the optical sensor. This image can be one or more scanlines long. An image of the illuminated bare imaging surface is then captured (block 1008). The image extends over the length of the optical sensor in the cross-process direction and includes the area in which a test pattern is later printed. For sensors with a fixed line scan frequency, the resolution of the image in the process direction is inversely proportional to the surface velocity of the imaging surface. For identifying some operational parameters of the printer, such as an ink drop position in the process direction, the resolution should be increased beyond the resolution corresponding to the surface speed during printing. This increase in resolution is achieved by slowing the surface speed of the imaging surface from the speed of the surface during printing.

A test pattern from which image quality metrics or any other metrics that enable identification of operational parameters of the printer to be determined are printed onto the drum (block 1012). The ink drops ejected to form the test pattern correspond to data stored in the memory of the printer that are used to operate the printheads. An image of the test pattern is captured with the optical sensor (block 1016). The images of the bare surface and the printed surface can be obtained in a variety of ways. The two images can be captured during two rotations of the imaging surface in which the bare imaging surface is captured first, the test pattern printed on the surface, and the image of the test pattern taken during the second rotation of the surface. The two images can be a single image that extends across the width of the imaging surface with a length that is up to twice the circumference of the imaging surface. The order can also be reversed, so the test pattern is printed first, transfixed to media, and then the image of the bare surface is captured. In one embodiment, the bare image surface is captured and stored in a memory of the printer, then retrieved each time a new test pattern is captured and processed.

Figure 5:
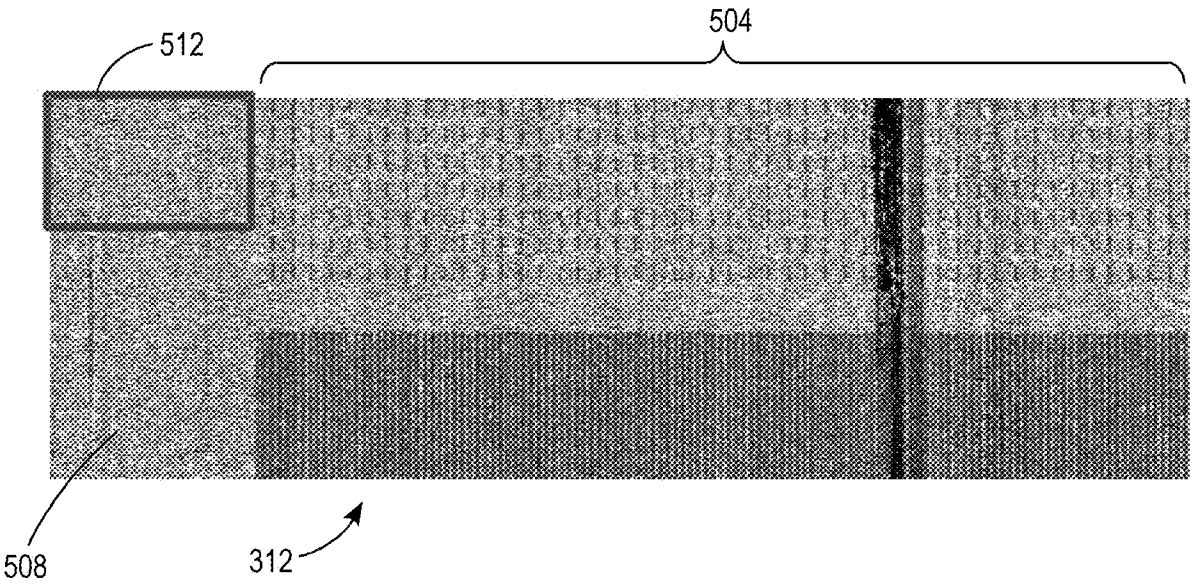
FIG. 5 is an image of an imaging surface that shows a portion of the imaging surface that is printed and a margin of the imaging surface that is not printed.

A portion of a printed surface image is shown in FIG. 5. Print area 504 of the imaging surface 312 is positioned opposite the printheads so it can be printed. Print area 504 is smaller than the width of the imaging surface 312 to ensure the printheads eject ink onto the imaging surface 312 and transfix the ink image to media in the transfix nip 18. The region of the imaging surface between the edge of the printable area portion 504 and the edge of the imaging surface is called an imaging surface margin in this document. This region is identified with reference number 508 in FIG. 5. The optical sensors 94A to 94D are wider than the width of the imaging surface 312 so the entire imaging surface can be imaged. A portion of the captured image in the margin is called a template in this document. Templates are used to identify an area in the bare imaging surface image data that corresponds to an area in the subsequent images of the imaging surface, which typically include test patterns. In FIG. 5, area 512 is a template. The image of the surface in FIG. 5 is a 200 by 600 pixel image cropped from an image that is 30,000 scanlines long in the process direction and 8932 pixels wide in the cross-process direction. The template depicted in FIG. 5 is approximately 75 pixels by 50 pixels. In template 512, the surface structure is monitored at 3,750 different positions. Because the surface is highly structured, a weak correlation exists between neighboring pixels in the template and the response of the detectors that imaged this portion of the surface can be thought of as sampling a random distribution of pixels.

Figure 6:
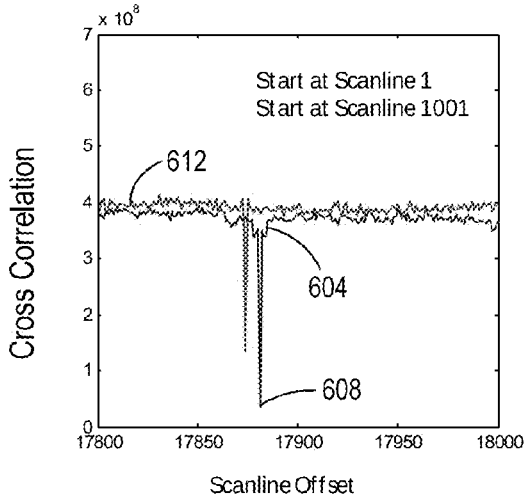
FIG. 6 is a graph of cross-correlation measurements to scanline offsets in two template comparisons.

For the particular image capture shown in FIG. 5, the bare surface image was captured first during a full rotation of the surface followed by the printing and imaging of the imaging surface with the test pattern. From the known average drum velocity and the known line scan rate of the optical sensor, the imaging surface is expected to turn a complete revolution in 17,900 scanlines. Therefore, the surface structure is expected to repeat every 17,900 scanlines, if the surface speed is uniform. FIG. 6 shows a graph 604 of cross-correlation measurements between a template that starts at scanline 1 and ends at scanline 50 in the bare surface image and all templates in the image that have the same area as the template, but begin somewhere between 17,800 and 18,000 scanlines later in the bare surface image. The value of about $3.8\times10^8$ for most of the cross-correlation measurements indicates no correlation occurs between the pixels in the template beginning at scanline 1 and most of the templates that begin somewhere in the range of 17,800 to 18,000 scanlines. At approximately scanline 17,880, however, the cross-correlation measurement drops significantly to point 608, which indicates the surface structures in these templates correspond to one another. Thus, a minimum in the cross-correlation measurements identifies the area in a first image that corresponds to the same area in a second image. The expectation at a uniform surface speed is that the data in the template at scanline 1 is repeated at scanline 17,901, but variation in the surface speed results in the repetition occurring at scanline 17,880 instead.

The graph 612 in FIG. 6 depicts cross-correlation measurements between the templates located between the 17,800 to 18,000 scanlines after the star of the template and the template that begins at scanline 1001 and ends at scanline 1050 of the first image. Because the average drum velocity between scanline 1 and approximately 17,880 scanlines later is slower than the average drum velocity between scanline 1001 and approximately 17,880 scanlines later, the alignment is more closely spaced. Thus, for each template in a second image, a plurality of cross-correlation measurements between that template and a sliding window of templates through a portion of the first image needs to be measured to find the template in the bare surface image that best aligns with the template in the second image. Consequently, the search is not performed for the entire image at one time, but by selecting templates from the second image in the process direction and identifying the templates in the first image that best align with the selected templates in the second image. Although the alignment can only be checked in the margin because the surface structure of the drum is the same in that region in both the first image and the second image, the alignment holds in the cross process direction because the rotating member is a rigid body.

Figure 7:
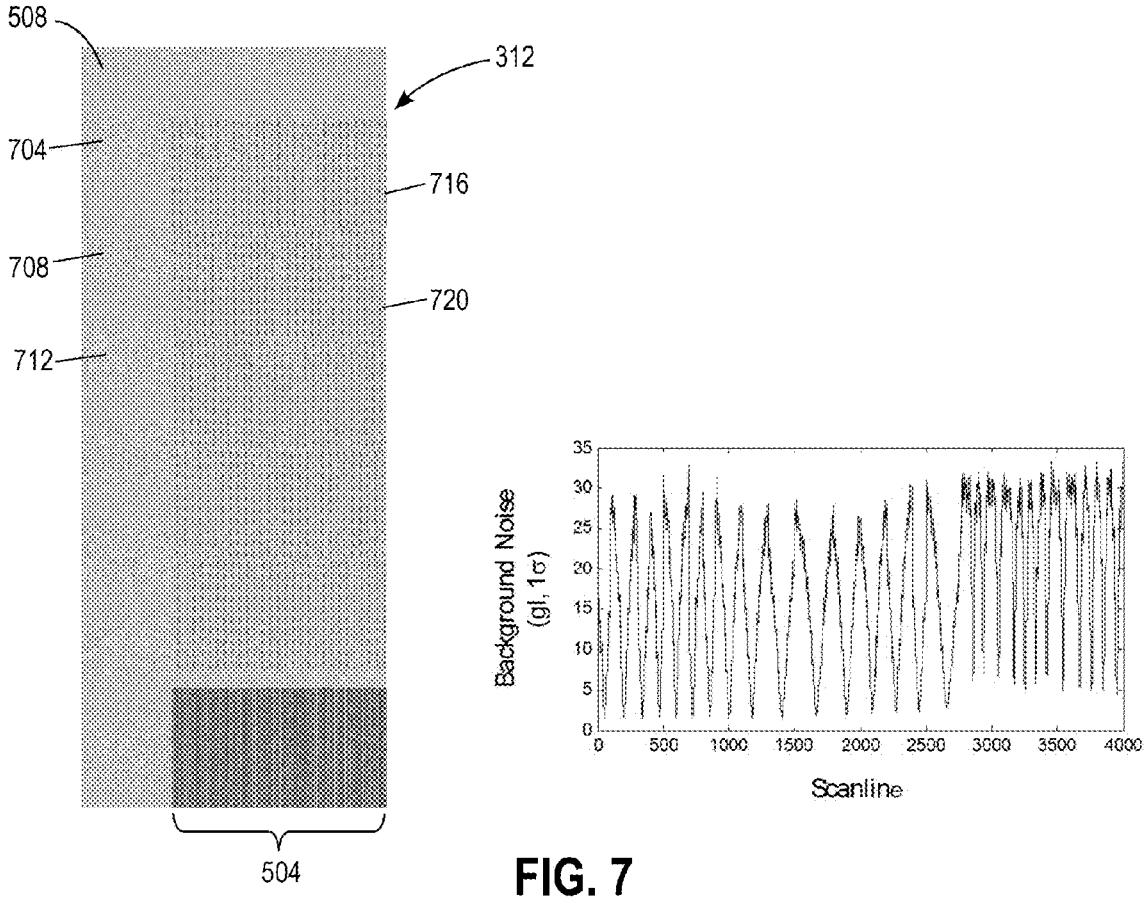
FIG. 7 illustrates a banding distortion in two images that were not synchronized when the images were captured and a graph of the noise in the image.
Figure 8:
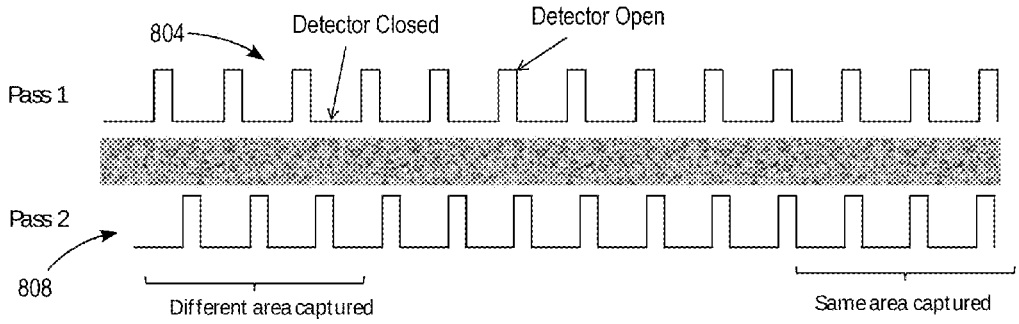
FIG. 8 is an illustration of the times a detector is open for light collection during capture of a first image and the times a detector is open for light collection during capture of a second image.

One other issue is now discussed before continuing with the description of the process 1000. A ratio of two images of an imaging surface 312 is shown in FIG. 7. The image ratio was obtained by identifying the offset for a set of templates in the process direction. The image ratio has a margin 508 and a print area 504 as noted previously. Additionally, the image ratio includes bands 704, 708, and 712 where removal of the background noise appears to have failed, but between these bands are bands 716 and 720 where the removal of background noise appears to have worked successfully. These bands are better quantified in the plot shown in FIG. 7. In that plot, the standard deviation of the gray level in the margin region 508 is plotted as a function of process direction position. The amplitude peaks are located in the grainy bands of the image ratio where no significant elimination of the background noise occurs. These problems arise because the structure on the drum has a higher spatial frequency than the resolution of the sensor. Although a correlation exists between each pixel in the first image template and the second image template, the correlation is not precisely exact because slightly different areas of the drum are captured. These problems also occur if the time for which the detectors of the optical sensor gather light is not kept at a maximum time for the detectors. This problem is illustrated in FIG. 8. The set of pulses 804 show when the detector is open and collecting light and when it is closed and not collecting light during the imaging of a bare surface. The set of pulses 808 show the opening and closing of the detector after the imaging surface has made a complete revolution and the image data for the test pattern on the surface is being collected. No controller aligns the pulses, and, consequently, the alignment of the pulses depends on surface speed. If the pulses are not aligned, then regions of the surface that are adjacent to one another but that have different structure in them are captured. Some cross-correlation occurs between adjacent regions because the field of view of a detector has some spatial extent, but the subsequent view differs from the first view because the fine level structure in the second view reflects light differently. Therefore, the matching of templates in different images is effective for areas where the pulses are aligned, but this matching degrades when the pulses do not align. This misalignment is another source of the banding shown in FIG. 7, which occurs as the pulses go in and out of alignment.

Figure 9:
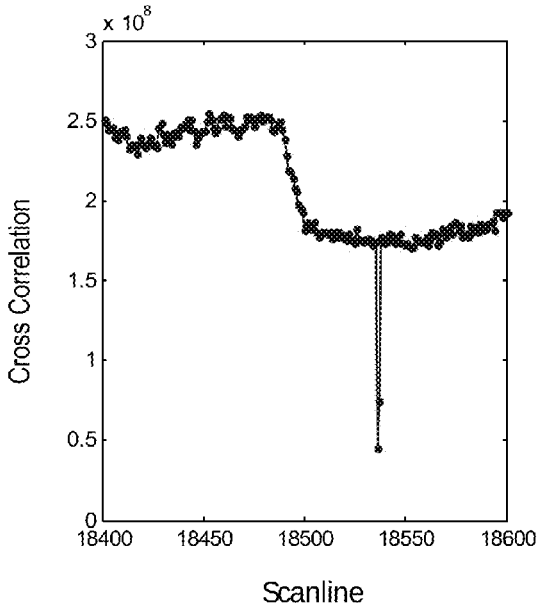
FIG. 9 is a graph of cross-correlations between two images.

This pulse alignment problem is partially solved by increasing the time the detectors remain open to collect light as close to 100% as possible. This opening of the detectors increases the duty cycle of the pulses to a train of pulses with very short periods of closure. Additionally, a calibrated band of image data is interpolated from two areas of image data that correspond to an aligned template. This calibrated band of data is used to remove the background noise. FIG. 9 shows cross-correlation measurements similar to the ones shown in FIG. 6, but the individual points are represented with dots. At 18,540 scanlines later, a first minimum in the graph at has a value of $0.5\times10^8$ and a second minimum at 18,541 scanlines later has a value of approximately $0.7\times10^8$. The appearance of two minimums close to one another occurs when complete alignment does not occur between the openings of the detectors during the capture of the first image and the openings of the detectors during the capture of the second image. These values indicate that a slightly better alignment exists between the template in the bare surface image and the template in the image of the test pattern image at a separation of 18,540 scanlines than at a separation of 18,541 scanlines. Both of these regions, however, overlap due to the misalignment of the detector openings noted above. Because the detector is fully open, the background image that should be used for noise removal is a weighted sum of the area in the print area that corresponds to the template and the area in the print area that corresponds to the template shifted one pixel in the process direction. The weights for the contribution of the values from the two areas are determined from the values of the first and second minimums. For specificity, consider the case where the template match at an earlier scanline is better, which means it has a lower cross-correlation than the template match at the next scanline, such as is illustrated in FIG. 9. Let $c_0$ be the cross-correlation at the earlier scanline, which is a separation of 18,540 scanlines. Let $c_1$ be the cross-correlation at the next scanline, which is a separation of 18,541 scanlines. Let $c_2$ be the cross-correlation at scanlines in the vicinity of $c_0$ and $c_1$ where no meaningful cross-correlation exists between the two images. Define a quantity $f=1-0.5*(c_2-c_1)/(c_2-c_0)$. A calibrated band is interpolated between the two images as a weighted sum of f times the image starting at scanline 18,540 and (1−f) times the image starting at scanline 18,541 and this calibrated band is used for background noise removal.

With this information in mind, the description of the process in FIG. 10 is continued. A template is selected in the image data of the second image that corresponds to an area that is outside an area that can be printed by any printhead (block 1012). A template is also selected in the image data of the first image that corresponds to an area that is outside the area that can be printed by any printhead (block 1016). A cross-correlation is measured between the selected template of image data in the first image and the selected template of image data in the second image (block 1020). The process continues to select another template in the image data of the first image that is outside the area that can be printed by any printhead (block 1024) and measuring cross-correlation between the selected template in the first image and the second template in the image data of the second image (block 1028) until a predetermined number of areas are selected (block 1032). After the cross-correlation measurements between the second template in the second image and the plurality of first templates in the first image have been obtained, the process identifies the template in the first image data having the minimum cross-correlation measurement as being best aligned with the second template in the second image (block 1036). The process also identifies a second template in the first image having the next smallest cross-correlation measurement (block 1040) and generates a calibrated band with reference to the template having the minimum cross-correlation measurement and the template having the next smallest cross-correlation measurement (block 1044). The calibrated band is produced in the manner noted above. This calibrated band is removed from the image data in the second image that extends from the template in the second image through the print area 504 to reduce the noise in the band in the second image (block 1048). The background noise is removed by subtracting the offset of each detector that was identified with reference to the image of the rotating member taken without any light source shining on the image from the image of the rotating member having ink ejected on it. Then a ratio of this adjusted image to the calibrated band is identified to remove the rotating member structure from the ink image.

Process 1000 continues by selecting another template of image data in the second image (block 1020) and measuring a plurality of cross-correlations between the next template in the second image and a predetermined number of selected templates in the first image (blocks 1024 to 1032). The two templates corresponding to the two smallest cross-correlation measurements are used to generate the calibrated band that is used to remove noise from the image band in the second image that corresponds to the template in that image (blocks 1036 to 1048). This process of selecting a template in the second image and generating a calibrated band with reference to two templates identified in the first image that is used to remove noise from an image band in the second image that corresponds to the template in the second image continues until the entire test pattern in the ink image has been process to remove the background structure. In some circumstances, the test pattern extends around the entire circumference of the drum. In this case, the process ends when the templates in the second image form a circumference area about the rotating member that corresponds to a circumference area about the rotating member formed by the aligning templates in the first image (block 1052). The reduced noise image bands in the second image are processed by the controller to identify the ejected ink on the surface of the rotating image member within the print area of the second image (block 1056). The identification of the ejected ink is used by the controller to operate the printer to evaluate operational parameters in the printer and make adjustments, if necessary (block 1060).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of printer operation comprising:

generating with an optical sensor having a plurality of detectors first image data of a surface of a rotating member while the surface is bare of ink, the rotating member being positioned to rotate in front of at least one printhead to form an ink image on the surface of the rotating member;

operating the at least one printhead to eject ink onto the surface of the rotating member with reference to data stored in the printer;

generating second image data of the surface of the rotating member while the ejected ink corresponding to the data stored in the printer is on the surface of the rotating member;

aligning the first image data with the second image data;

reducing noise in the second image data with reference to the first image data aligned with the second image data;

processing the second image data having reduced noise to identify the ejected ink on the surface of the rotating image member; and operating the printer with reference to the ejected ink identified on the surface of the rotating image member.

2. The method of claim 1 further comprising:

identifying an offset for each detector in the optical sensor in a printer that is positioned to generate image data of the surface of the rotating member; and removing the offset from the second image data before reducing the noise in the second image data.

3. The method of claim 2, the identification of the offset for each detector further comprising:

deactivating a light source positioned to illuminate the surface of the rotating member; and generating third image data of the surface of the rotating member, the third image data corresponding to the offsets identified for the detectors in the optical sensor.

4. The method of claim 1 further comprising:

operating the detectors of the optical sensor at a maximum sampling period.

5. The method of claim 1, the alignment of the first image data and the second image data further comprising:

selecting a first area of image data in the first image data that is outside an area in the first image data that can be printed by the at least one printhead;

selecting a second area of image data in the second image data that is outside an area in the second image data that can be printed by the at least one printhead;

measuring cross-correlation between the selected first area of image data and the selected second area of image data;

continuing to select another area of image data in the first image data that is outside the area in the first image data that can be printed by the at least one printhead and measuring cross-correlation between the selected other area of image data and the second area of image data until a predetermined number of areas are selected;

identifying one of the selected areas in the first image data as being aligned with the second area of image data in the second image data in response to the cross-correlation measurement between the identified one of the selected areas in the first image data and the selected second areas of image data in the second image data being a minimum for the cross-correlations measured for the predetermined number of selected areas; and identifying a first area of image data within an area in the first image data that can be printed by the at least one printhead with reference to the identified one selected area, the identified first area of image data within the area in the first image data that can be printed by the at least one printhead being used to reduce noise in image data in the second image data that is within an area of the second image data that can be printed by the at least one printhead that corresponds to the selected second area of image data in the second image data.

6. The method of claim 5 further comprising:

continuing to select another second area of image data in the second image data and measuring a plurality of cross-correlations between the selected other area of image data in the second image data and a predetermined number of selected areas of image data in the first image data until each selected area of image data in the second image data has a corresponding aligning area of image data in the first image data, the selected areas of image data in the second image data having a length in the process direction that corresponds to a length of the ejected ink on the surface of the rotating member in the process direction.

7. The method of claim 6 further comprising:

identifying a second aligned area of image data in the first image data for each selected second area in the second image data with reference to the cross-correlation measurements obtained with respect to each selected second area in the second image data;

identifying a second area of image data within the area in the first image data that can be printed by the at least one printhead with reference to the identified second aligned area in the first image data;

interpolating an area of image data with reference to the identified first area of image data within the area in the first image data that can be printed by the at least one printhead and the identified second area of image data within the area in the first image data that can be printed by the at least one printhead, an interpolated area of image data being generated for each selected second area of image data in the second image data; and reducing noise in the image data of the second image data that is within an area of the second image data that can be printed by the at least one printhead and that also corresponds to each selected second area of image data in the second image data, the noise in the second image data being reduced with reference to a ratio of the interpolated areas of image data generated for the selected second areas of image data in the second image data and the selected second areas of image data in the second image data.

8. The method of claim 7, the identification of the second area of image data within the area in the first image data that can be printed by the at least one printhead further comprising:

identifying the second area of image data as the identified first area of image data within the area in the first image data that can be printed by the at least one printhead shifted by one pixel in a process direction; and the interpolation further comprising:

weighting values in the identified first area of image data and the identified second area of image data with reference to the minimum cross-correlation measurement and a next smallest cross-correlation measurement.

9. A printer comprising:

at least one printhead configured to eject ink;

a rotating member being positioned to rotate in front of the at least one printhead to enable the at least one printhead to eject ink onto a portion of a surface of the rotating member to form an ink image on the surface portion of the rotating member;

at least one optical sensor having an a linear array of detectors that extends across a width of the rotating member, the at least one optical sensor is configured to generate image data of the surface portion of the rotating member and a margin of the surface of the rotating member; and a controller operatively connected to the at least one optical sensor, the controller being configured to:

receive from the at least one optical sensor first image data of the surface portion and margin of the rotating member without ink, operate the at least one printhead to eject ink on the surface portion of the rotating member, the ejected ink corresponding to data stored in a memory of the printer, receive from the at least one optical sensor second image data of the surface portion and margin of the rotating member bearing the ejected ink, align the first image data that corresponds to the margin of the rotating member with the second image data that corresponds to the margin of the rotating member, reduce noise in the second image data that corresponds to the surface portion of the rotating member with reference to image data in the first image data in the surface portion, the image data in the first image data used to reduce noise being aligned with the image data in the margin of the rotating member in the first image data that is aligned with the second image data that corresponds to the margin of the rotating member, process the second image data having reduced noise to identify the ejected ink on the surface portion of the rotating member, and operate the printer with reference to the ejected ink identified on the surface portion of the rotating member.

10. The printer of claim 9, the controller being further configured to:

identify an offset for each detector in the at least one optical sensor in the printer that is positioned to generate image data of the surface of the rotating member; and remove the offset from the second image data before reducing the noise in the second image data.

11. The printer of claim 10, the at least one optical sensor further comprising:

a light source positioned to illuminate the surface of the rotating member; and the controller being further configured to deactivate the light source to enable the at least one optical sensor to generate third image data of the surface of the rotating member that enables identification of the offset for each detector.

12. The printer of claim 9, the controller being further configured to:

operate the detectors of the optical sensor at a maximum sampling period.

13. The printer of claim 9, the controller being further configured to:

select a first area of image data in the image data that corresponds to the margin of the rotating member;

select a second area of image data in the image data that corresponds to the margin of the rotating member;

measure cross-correlation between the selected first area of image data and the selected second area of image data;

continuing to select another area of image data in the first image data that corresponds to the margin of the rotating member and measuring cross-correlation between the selected other area of image data corresponds to the margin of the rotating member and the second area of image data corresponds to the margin of the rotating member until a predetermined number of areas are selected;

identify one of the selected areas in the first image data as being aligned with the second area of image data in the second image data in response to the cross-correlation measurement between the aligned areas being a minimum for the cross-correlations measured for the predetermined number of areas; and identifying a first area of image data in the first image data that corresponds to the surface portion of the rotating member with reference to the one selected area in the first image data identified as being aligned with the second area of image data in the second image data, the identified first area of image data that corresponds to the surface portion of the rotating member being used to reduce noise in image data in the second image data that corresponds to the surface portion of the rotating member in the second image data.

14. The printer of claim 13, the controller being further configured to:

continue to select another second area of image data in the second image data that corresponds to the margin of the rotating member and measure a plurality of cross-correlations between the selected other area of image data in the second image data and a predetermined number of selected areas of image data in the first image data corresponds to the margin of the rotating member until each selected area of image data in the second image data has a corresponding aligning area of image data in the first image data, the selected areas of image data in the second image data having a length in the process direction that corresponds to a length of the ejected ink on the surface of the rotating member in the process direction.

15. The printer of claim 14, the controller further configured to:

identify a second aligned area of image data in the first image data that corresponds to the margin of the rotating member for each selected second area in the second image data that corresponds to the margin of the rotating member with reference to the cross-correlation measurements obtained with respect to each selected second area in the second image data that corresponds to the margin of the rotating member;

identify a second area of image data in the first image data that corresponds to the surface portion of the rotating member with reference to the second aligned area in the first image data that corresponds to the margin of the rotating member;

interpolating an area of image data with reference to the identified first area of image data in the first image data that corresponds to the surface portion of the rotating member and the identified second area of image data in the first image data that corresponds to the surface portion of the rotating member, an interpolated area being generated for each selected second area of image data in the second image data that corresponds to the margin of the rotating member; and reducing the noise in the image data of the second image data that corresponds to the surface portion of the rotating member and that also corresponds to each selected second area of image data in the second image data, the noise in the second image data being reduced with reference to a ratio of the interpolated areas of image data generated for the selected second areas of image data in the second image data and the selected second areas.

16. The printer of claim 15, the controller being further configured to:

identify the second area of image data as the identified first area of image data in the first image data that corresponds to the surface portion of the rotating member shifted by one pixel in a process direction, and weight values in the identified first area of image data and the identified second area of image data with reference to the minimum cross-correlation measurement and a next smallest cross-correlation measurement.

* * * * *